US007546959B2

(12) United States Patent
Wagner et al.

(10) Patent No.: US 7,546,959 B2
(45) Date of Patent: Jun. 16, 2009

(54) CLEANING NOZZLE

(75) Inventors: Hans Dieter Wagner, Bretzfeld (DE); Simon Simpfendoerfer, Heilbronn (DE); Ulrich Simpfendoerfer, Robert-Bosch-Strasse 4, Bretzfeld (DE) 74626; Martin Hurlebaus, Bretzfeld (DE)

(73) Assignee: Ulrich Simpfendoerfer (DE)

( * ) Notice: Subject to any disclaimer, the term of this patent is extended or adjusted under 35 U.S.C. 154(b) by 0 days.

(21) Appl. No.: 11/733,321

(22) Filed: Apr. 10, 2007

(65) Prior Publication Data

US 2008/0035184 A1 Feb. 14, 2008

(30) Foreign Application Priority Data

Aug. 11, 2006 (EP) ..... 06016757

(51) Int. Cl.
*B05B 3/06* (2006.01)

(52) U.S. Cl. ..... 239/252; 239/251; 239/256; 239/259

(58) Field of Classification Search ..... 239/251, 239/252, 256, 259, 261, 264
See application file for complete search history.

(56) References Cited

U.S. PATENT DOCUMENTS 4,193,548 A 3/1980 Meyer
4,704,826 A * 11/1987 Kirkland ..... 239/256
5,503,334 A * 4/1996 Pacht ..... 239/252
6,193,169 B1 * 2/2001 Steinhilber et al. ..... 239/240
2004/0195362 A1 10/2004 Walker

FOREIGN PATENT DOCUMENTS

DE 102004022587 12/2005
EP 0645191 A2 3/1995
FR 2281177 3/1976

OTHER PUBLICATIONS

European Search Report for European Application No. 06016757, dated Jan. 30, 2007.

* cited by examiner

*Primary Examiner*—Steven J Ganey
(74) *Attorney, Agent, or Firm*—Darby & Darby P.C.

(57) ABSTRACT

The cleaning nozzle according to the invention having a nozzle body (100) and a nozzle head (104) arranged on a shaft (106) rotatably seated on said nozzle body, and having a cavity (107), which extends in axial direction in said nozzle body (100) and which is connected with a pressurized water supply (102), by means of which cavity pressurized water supplied via the pressurized water supply (102) is guided to the nozzle head (104) and is discharged to the outside in said nozzle head (104) by at least one nozzle orifice (118), is formed especially by a friction brake comprising at least two disc elements (108, 110) that are in mechanical contact one with the other in the axial direction for restricting the rotational motion of the shaft (106).

15 Claims, 3 Drawing Sheets

Fig. 1 (SdT)

CLEANING NOZZLE

The present invention relates to a cleaning nozzle according to the preamble of Claim 1.

Cleaning nozzles suited for cleaning sewers or pipes, which do not provide easy access to cleaning personnel due to their small cross-sections, with the aid of high-pressure water jets have already been known. Such systems use pressurized water at pressures of up to 120 bars.

The known cleaning systems are provided, on one end of a cleaning hose, with a cleaning nozzle the exact mechanical properties of which depend on the particular cleaning purpose. It is, however, a general feature of such cleaning nozzles that the pressurized water is ejected through specifically arranged and, in some cases, specifically designed nozzle orifices.

In order to permit an inner pipe wall to be cleaned throughout, the above-mentioned cleaning nozzles are mounted to rotate on the pressure hose. By arranging one or more nozzle orifices obliquely in the circumferential area of the cleaning nozzle, a torque is produced by the jet pressure, based on the "principle of repulsion", that causes the cleaning nozzle, or a corresponding nozzle head, to rotate.

As is generally known, the speed of such rotation is dependent on the jet pressure of the pressurized water and cannot therefore be influenced independently of the jet pressure. However, as is likewise known, the cleaning effect decreases as the speed rises so that effective cleaning can be achieved only by a nozzle head rotating at a relatively low speed.

A cleaning nozzle of the kind mentioned above has been disclosed for example by EP 0 645 191 A2 and comprises a housing in which a turbine is arranged in the flow path of the pressurized water flowing through the housing. The turbine is mounted on a shaft, and a nozzle head is seated on the one shaft end that projects from the housing.

In order to provide a desirably low speed of the nozzle had head, especially in the case of high pressures of the pressurized water, the turbine is seated in the housing via an axial thrust bearing. The axial thrust bearing simultaneously acts as a friction brake the braking effect of which can be controlled through the fluid pressure of the pressurized water.

That automatic effect of the known cleaning nozzle, namely to limit the speed, obviously is due to the circumstance that in the presence of low pressures a fluid friction will initially build up in the axial gap between two bearing surfaces of the axial thrust bearing, due to the fluid flowing through the nozzle, which then enters a state of dry friction as the fluid pressure rises. Accordingly, the friction coefficient varies depending on the pressure, and the proportionality between the speed and the fluid pressure ends when a given fluid pressure is exceeded after which point the speed starts to drop again.

The nozzle head obviously is braked by fluid friction, i.e. by shearing of a fluid. The friction force obviously is constant and cannot be varied. This results in a "starting torque" that must be overcome to set the nozzle head into rotation.

It would, therefore, be desirable to provide a cleaning nozzle of the before-mentioned kind that permits the before-mentioned speed of the nozzle head to be influenced independently of the fluid pressure.

Specifically, the cleaning nozzle according to the invention comprises at least two disc elements, arranged in the area of a cavity provided in a nozzle body and getting/being in mechanical contact in the direction of flow of the pressurized water (i.e. preferably in axial direction), which form a friction brake that acts to restrict the rotational motion of the shaft.

In contrast to the at least two friction elements, the known nozzle, which has been described above, comprises a single flow passage element only in the form of the before-mentioned axial thrust bearing (FIG. 1). In addition, the braking effect of the known nozzle is presumably achieved by means of an inlet bore provided above the turbine and directed in opposite sense to the flow of the pressurized water (FIG. 1).

In the case of the cleaning nozzle according to the invention, it is specifically provided that pressurized water flowing through the cleaning nozzle is emitted tangentially in the circumferential direction of the nozzle head, from at least one nozzle orifice, in order to thereby exert a torque on the shaft. The cleaning nozzle according to the invention therefore does not need a turbine to drive the shaft.

According to an especially advantageous embodiment, the cleaning nozzle according to the invention comprises a sleeve body in which the at least two disc elements are supported, the sleeve body forming on the inside of the said cavity an edge at which a counter-pressure or turbulence is produced in the pressurized water flowing through the space whereby the contact pressure of the at least two disc elements is increased. Advantageously, the contact pressure of the at least two disc elements can be precisely adjusted by simply varying the width of that edge.

According to one advantageous embodiment of the invention, the surfaces of the two disc elements (flow passage elements), being arranged one opposite the other or being in contact one with the other and preferably consisting of glass, may be respectively designed to be relatively smooth or less rough on the one hand, and relatively rough on the other hand. This has the effect to limit the frictional grip and to effectively prevent the two ceramic disc from sliding by jerks one relative to the other.

According to another embodiment of the invention, the sliding bearing for the shaft, simultaneously formed by the two disc elements, is formed by a ceramic sliding bearing whereas the known nozzle comprises a plastic sliding bearing. Preferred as materials for the two disc elements are known oxidic and non-oxidic ceramic materials such as, preferably, aluminum oxide, silicon carbide or silicon nitride.

The cleaning nozzle according to the invention further differs from the known cleaning nozzle described above by the following additional features:

The cleaning nozzle according to the invention operates without any "starting torque" that has to be overcome in order to set the nozzle head into rotation.

Inside the housing of the cleaning nozzle according to the invention, a substantially laminar flow is produced whereas in the case of the known nozzle turbulences and vortexes are produced in the pressurized water due to the water flowing around the turbine shaft and the turbine blades.

In the case of the cleaning nozzle according to the invention the rotational drive is produced by the nozzle head, being set into rotation by the jet pressure produced on the propelling nozzle orifices provided especially for that purpose, i.e. according to the "principle of repulsion", whereas the described known nozzle has a turbine drive.

In contrast to a turbine drive, a nozzle jet drive is almost non-wearing and maintenance-free, thereby giving the nozzle a relatively long service life. In addition, the nozzle jet drive produces a direct cleaning effect whereas the turbine drive of the known nozzle initially only has the effect to set the turbine into rotation while the turbine as a rotating element does not as such provide any cleaning effect.

Further, the described structure makes the nozzle according to the invention suited for high-pressure use, at pressures of 50 to 300 bars. In contrast, the known nozzle is expressly said to be suited only for use in low-pressure applications, up to approximately 10 bars.

In the case of the cleaning nozzle according to the invention, the effect of braking rotation of the nozzle head is further reinforced by the before-mentioned sliding bearing, which has a sealing function as well as a braking function, and by the braking nozzle orifices being directed in opposite sense to the jet emission sense of the propelling nozzle orifices. By combining the different braking effects in the described way precise adjustment of the rotational speed of the nozzle head is rendered possible.

The cleaning nozzle according to the invention is applicable with special advantage for cleaning the interior of ducts or pipes that are difficult to access, in which case the rotational speed can be adjusted precisely and, especially, to relatively low values in an effort to achieve the best possible cleaning effect.

Due to the considerably simplified structure and increased stability, compared with the prior art, the cleaning nozzle according to the invention has a relatively long service life and is capable of operating even under emergency conditions, due to its particular structure. In fact, it may happen that the pressurized water flowing through the nozzle may be contaminated and may block the outlet opening of the nozzle head from the inside. If such blocked condition were to occur on a "braking nozzle", this would mean that rotation would increase considerably and that, consequently, the disc elements would be heated up by the sliding friction to a considerably higher degree. In case of disc elements made, for example, from plastic or a similar material rather than from a ceramic material this would mean a risk of damage to the disc elements and, lastly, a risk that rotation of the nozzle head might be blocked entirely. If, in contrast, a single "propelling nozzle" were blocked only, only the sense of rotation of the nozzle head would change while rotation of the nozzle head would still be ensured.

The cleaning nozzle according to the invention will be described hereafter with reference to the attached drawings from which further features and advantages of the invention will become apparent. Equal reference numerals will be used for identical or functionally similar features, especially in FIGS. 2 and 3.

IN THE DRAWINGS

Figure 1:
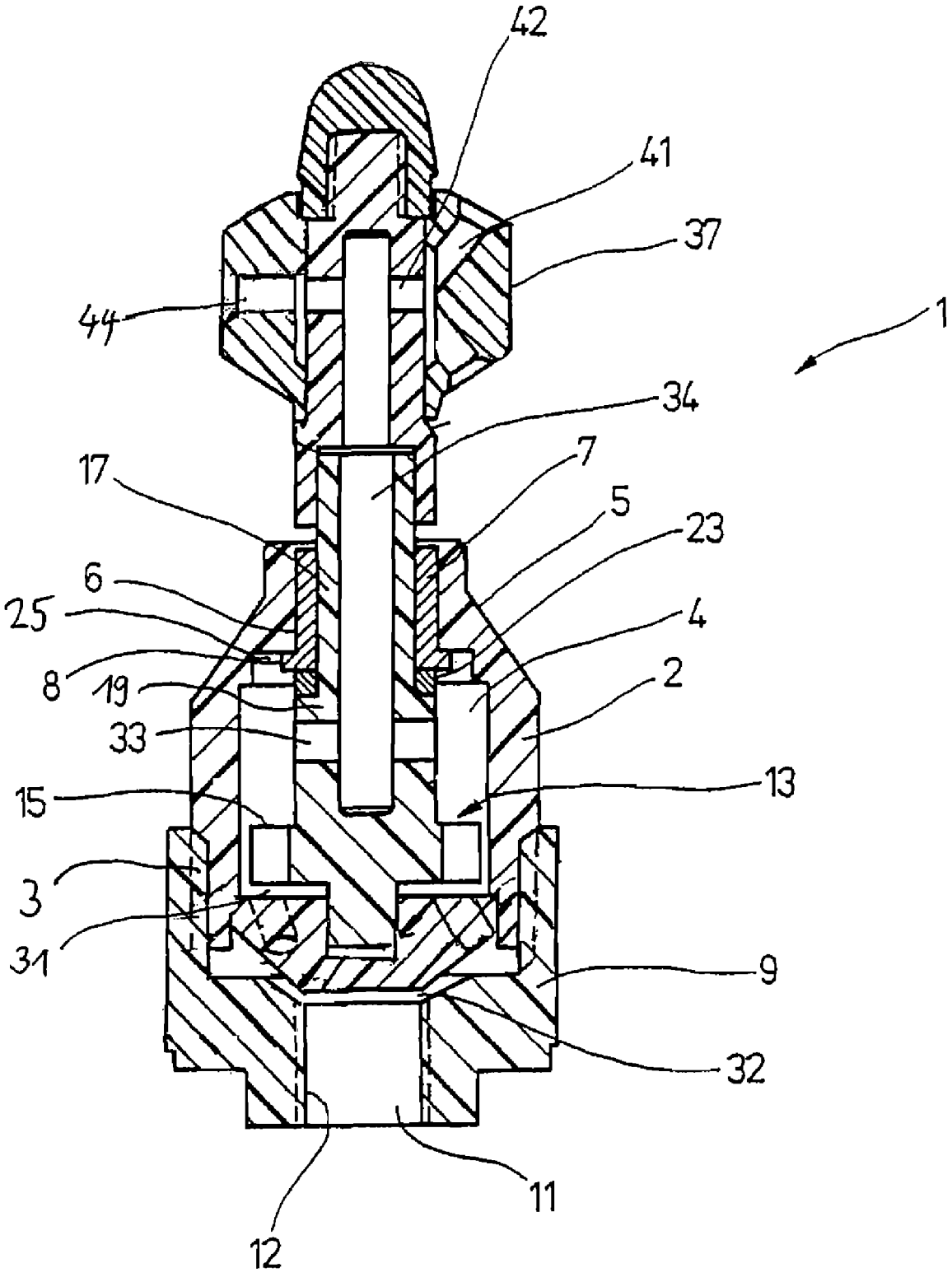
FIG. 1 shows a sectional view of a corresponding cleaning nozzle according to the prior art.

FIG. 1 shows a cleaning nozzle 1 of the kind described in EP 0 645 191 A1. The nozzle comprises a substantially cylindrical housing 2 provided with an outer thread 3 on its rear end. The housing 2 encloses a continuously cylindrical inner space 4 which transitions, at the end face 5 of the housing 2, into a bore 6 extending coaxially to the housing. Fitted in the coaxial bore 6 is a flange bushing 7, made from PTFE (polytetrafluoroethylene), which has its flange located in the inner space 4. Further, the nozzle comprises a fluid inlet 11 formed by a bore with an inner thread 12 that extends through the bottom of a cap nut 9.

A turbine 13, rotating inside the cylindrical inner space 4, is configured as a cylindrical disc and comprises turbine blades not visible in the described drawing. At its end 15, the disc forming the turbine 13 terminates without interruption in a turbine shaft 17.

Pressurized water supplied through the fluid inlet 11 is guided via oblique bores 32 into a pre-chamber 31 preceding the turbine 13, whereby the turbine 13 is set into rotation. The pressurized water then reaches a pressurized water chamber 33. From the pressurized water chamber 33, the pressurized water proceeds to a pressurized water channel 34, extending centrally in the turbine shaft 17, and finally, via the pressurized water channel 34, to a pressurized water discharge chamber 42 arranged in a nozzle head 37 from where the pressurized water is finally discharged in radially outward direction via nozzle-shaped fluid outlets 41, 44.

The axial forces of the turbine occurring during operation of the known cleaning nozzle 1 are absorbed by an axial bearing 23 the bearing surfaces of which are formed, respectively, by a flat inner end face of a flange 8 and by a ring 25 which is slipped onto the turbine shaft 17 and up to a shoulder 19.

A preferred embodiment of the cleaning nozzle according to the invention will now be described with reference to FIG. 2. In the present embodiment, the cleaning nozzle has a three-piece design, being composed of a central nozzle body 100, a pressurized water connection piece 102 and a nozzle head 104 arranged on a rotating shaft 106. In the arrangement of the present embodiment, the central nozzle body 100 and the pressurized water connection piece 102 are screwed together (detachably) at points not visible in FIG. 2. However, the two parts may also be connected, either detachably or non-detachably, in any other manner known to the man of the art, for example by welding. Correspondingly, the nozzle head 104 and the shaft 106 are screwed together in the present case at points likewise not visible in FIG. 2 although they might be connected, detachable or non-detachably, in any other way known to the man of the art, for example by welding. The shaft 106 as such is, however, rotatably seated in the central nozzle body 100, its rotary axis extending in axial direction.

Formed in the shaft 106, at the level of the central axis, is an axially extending cylindrical hollow space 107 by means of which pressurized water is supplied to the nozzle head 104 through a pressurized water supply opening 113 provided on the pressurized water connection piece 102, and from there to the outside via laterally provided nozzle orifices 118 and a central nozzle orifice 120 formed at the level of the central axis. The lateral nozzle orifices 118 simultaneously produce, due to the before-mentioned repulsion effect, on the one hand a cleaning effect acting substantially in a radially outward direction and, on the other hand, a rotary movement of the shaft 106. In contrast, the axially central nozzle orifice of the present embodiment only serves to produce a cleaning effect on the front of the nozzle head 104. The supply of the pressurized water from the cavity 107 to the said nozzle orifices 118, 120 is effected via corresponding pressurized water channels 116, 119 provided in the nozzle head 104.

Figure 2:
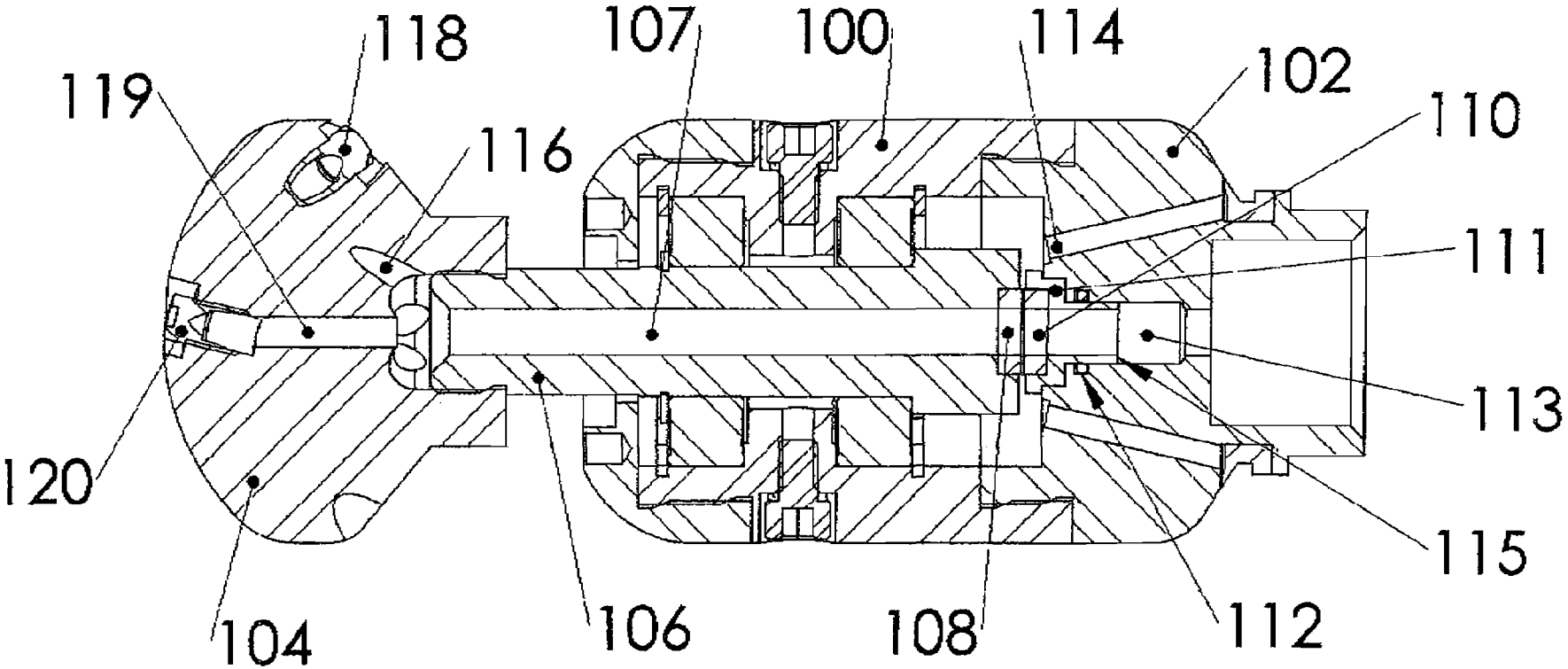
FIG. 2 shows a corresponding sectional view of a preferred embodiment of the cleaning nozzle according to the invention.

The cleaning nozzle illustrated in FIG. 2 is provided especially with a friction brake of the kind described at the outset for reducing the rotary movement of the shaft 106 or of the nozzle head 104 arranged on the shaft 106, respectively. In the illustrated embodiment, the friction brake consists of a first disc element 108, seated in a recess or cutout in the shaft 106, which recess is arranged concentrically relative to the rotary shaft 106, and of a second disc element 110 being in mechanical contact with the first disc element 108 and being embedded in a likewise concentric circular recess or cutout in a sleeve body 111.

With respect to their function, the two disc elements 108, 110 simultaneously form sliding bearings for the shaft 106 and are preferably made from a ceramic material. Due to the surface roughness of that material, an optimum friction coefficient is obtained during rotation of the two ceramic discs 108, 110. Further, the two disc elements 108, 110 are frictionally embedded in the said recesses or cutouts whereby any movement or rotation of the elements in the recesses during rotation is prevented so that the maximum frictional force will be available at the point of contact between the two disc elements 108, 110 during rotation of the shaft 106.

Figure 3:
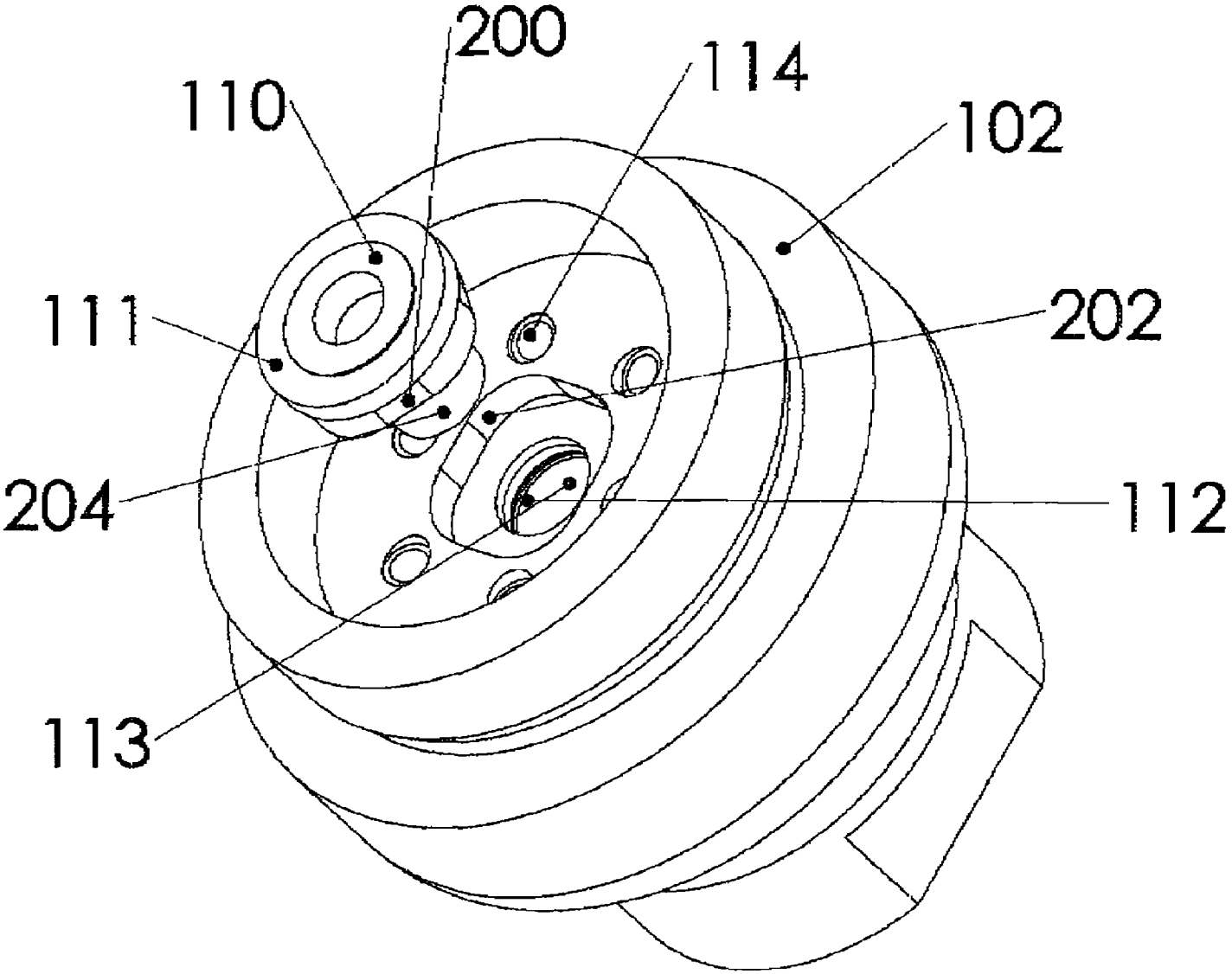
FIG. 3 shows an enlarged exploded view of the embodiment of the friction brake illustrated by the sectional view of FIG. 2.

The sleeve body 111 is sealed relative to the pressurized water connection piece 102 by an O ring 112 in order to prevent, as far as possible, any pressurized water from being pressed out from between the outer wall of the sleeve body 111 and the opposite inner wall of the pressurized water connection piece 102. In case any "excess" pressurized water should still be pressed out—a condition that never can be fully excluded—such water will be carried off by a plurality of pressurized water discharge channels 114 arranged along a concentric circle (FIG. 3). At the same time, the O ring 112 prevents the braking effect of the two disc elements 108, 110 from becoming excessively high.

According to the invention, the friction produced by the friction brake 108,110 during rotation of the shaft 106, which counteracts the rotary movement, is especially produced or reinforced by the fact that on its way through the pressurized water supply opening 113 and the cavity 107 in the area of the annular edge of step 115 of the sleeve body 111, projecting beyond the inner wall of the cavity 107, the pressurized water will "hit against" or form slight turbulences against such edge, thereby increasing the contact pressure between the two disc elements 108, 110. Consequently, the increase of the contact pressure can be adjusted precisely and continuously by varying the width of the edge 115 in the radial direction.

As has been described before, the nozzle head 104 is driven via the jet-propelled nozzle orifices 118, 120. Braking the rotary movement of the nozzle 104 is effected inside a hollow thrust pad to which a flow of pressurized water is supplied and which is pressed against the shaft end of the drive shaft by a cylinder. The friction moment thereby obtained counteracts the torque of the rotor head, thereby reducing its speed. The brake bodies used consist of two ceramic discs resting flat one against the other so that only minor quantities of leakage water will be permitted to escape during rotation which means that the discs simultaneously act as sealing elements. Accordingly, the system can do without any high-pressure lip seal of the kind required by the system of the prior art.

The two ceramic discs 108, 110 act as seal and simultaneously as brake. This allows the desired speed to be precisely and finely adjusted in the system of the invention via a pressurized water flow guided through the brake nozzle orifices while maintaining the relatively slow rotation of the nozzle head over a wide pressure range of approximately 70 to 150 bars, without any loss in function.

The two ceramic discs 108, 110 may be formed as one-piece or as multi-piece units. A spring biasing means provided for the ceramic discs 108, 100 effectively prevents any penetration of dirt. The present rounded rectangular shape prevents any torsional movement of the one ceramic disc so that the latter remains fixed against rotation relative to the nozzle housing.

As regards the surfaces of the two ceramic discs 108, 110 that are in contact one with the other, an arrangement is preferred where the one surface is relatively smooth while the other surface is relatively rough so that static friction between the two surfaces will not become excessively high and sliding by jerks of the two ceramic discs 108, 110, one relative to the other, will be effectively prevented.

As can be further seen in FIG. 2, the pressurized water is supplied to the nozzle head 104 via a radially central pressurized water supply opening 113, i.e. along a straight path. In the case of the nozzle illustrated in FIG. 1, in contrast, the pressurized water is introduced at the inlet via oblique bores in order to set the turbine into rotation. To say it in other words, the water enters the shaft above the turbine only, in the reinforced part of the shaft, via oblique braking bores, at an angle of approximately 90°.

In the case of the cleaning nozzle according to the invention, the incoming pressurized water flows through the two ceramic discs 108, 110 directly, whereas in the case of the nozzle described in FIG. 1, the pressurized water flows through the shaft only while the two sliding bearings are arranged outside the shaft. It is that direct "contact" with the pressurized water that finally permits the described precise adjustment of the friction effect.

The high flow rate of the pressurized water further results in the known "water-jet blast effect", i.e. a partial vacuum dependent on the flow rate, due to which a suction effect is additionally produced between the two ceramic discs 108, 110. That suction effect, which acts to increase the friction effect, is missing completely in the cleaning nozzle illustrated in FIG. 1 since, as has been mentioned before, the sliding bearings of that nozzle are not even passed by the pressurized water.

FIG. 3 once more shows the pressurized water connection piece 102 illustrated in FIG. 2 and the different parts of the friction brake according to the invention, likewise illustrated in FIG. 2, in an enlarged exploded view. As can be seen in particular in FIG. 3, the sleeve body 111 described above has a laterally flattened shape in a transition area 200 and engages a recess 202 of a corresponding non-circular shape in the pressurized water connection piece 102. That flattened portion 200 prevents the sleeve body 111 from rotating with the two ceramic discs 108,110 during relative rotation of the two discs, which otherwise would reduce the friction force between the two ceramic discs 108, 110.

The end portion 204 of the sleeve body 111, being likewise contracted in the said transition area 200, engages the pressurized water supply opening, engages the pressurized water connection piece 102 by friction, forming in this position the annular edge that has been described above in detail and which likewise influences the contact pressure between the two ceramic discs 108, 110. Further, the before-mentioned O ring 112 is indicated in FIG. 3, as are the openings of the concentric pressurized water discharge channels 114.

The invention claimed is:

1. A cleaning nozzle having a nozzle body and a nozzle head arranged on a shaft rotatably seated on said nozzle body, and having a cavity, which extends substantially in the axial direction in said nozzle body and which is connected with a pressurized water connection supply, wherein pressurized water supplied via the pressurized water connection supply is guided to the nozzle head by the cavity and is discharged from the nozzle head to the outside by at least one nozzle orifice, wherein said cleaning nozzle comprises at least two disc elements, arranged in the area of the cavity and moving substantially into mechanical contact one with the other in the direction of flow of the pressurized water, wherein the second one of the at least two disc elements is embedded in a concentrically arranged circular recess of a sleeve body which forms an edge on the inside of the cavity, on which the pressurized water flowing through the cavity produces turbulence or vortexes through which the contact pressure of the at least two disc elements is increased, wherein the at least two disc elements form a friction brake that acts to restrict the rotational motion of the shaft.

2. The cleaning nozzle as defined in claim 1, characterized in that the pressurized water is emitted tangentially in the circumferential direction of the nozzle head, from the at least one nozzle orifice, in order to thereby exert a torque on the shaft.

3. The cleaning nozzle as defined in claim 2, characterized in that the first one of the at least two disc elements is embedded in a recess of the shaft which is arranged concentrically relative to the rotary axis of the shaft.

4. The cleaning nozzle as defined in claim 1, characterized in that the first one of the at least two disc elements is embedded in a recess of the shaft which is arranged concentrically relative to the rotary axis of the shaft.

5. The cleaning nozzle as defined in claim 4, characterized in that the first one and/or the second one of the at least two disc elements is/are embedded by friction.

6. The cleaning nozzle as defined in claim 1, characterized in that the at least two disc elements simultaneously act as sliding bearings for the shaft.

7. The cleaning nozzle as defined in claim 1, characterized in that the one of the at least two disc elements has a relatively smooth surface, at least on the side of the contact surface of the two disc elements, and that the respective other disc element has a relatively rough surface, at least on the side of the contact surface of the two disc elements.

8. The cleaning nozzle as defined in claim 7, characterized in that the at least two disc elements are made from a ceramic material, preferably from $Al_2O_3$.

9. The cleaning nozzle as defined in claim 1-4, characterized in that the sleeve body is sealed relative to the nozzle body by a gasket.

10. The cleaning nozzle as defined in claim 1-4, characterized in that any pressurized water that may penetrate from between the sleeve body and the nozzle body is recycled via pressurized water discharge channels.

11. The cleaning nozzle as defined in claim 1, characterized in that the contact pressure between the at least two disc elements can be adjusted by varying the width of the edge.

12. The cleaning nozzle as defined in claim 1, characterized in that the at least two disc elements are of a one-piece or of a multi-piece design.

13. The cleaning nozzle as defined in claim 1, characterized in that the at least two disc elements are mechanically spring-biased one relative to the other.

14. The cleaning nozzle as defined in claim 1, characterized in that at least one of the at least two disc elements has a contour of the outer surface different from a circular shape.

15. The cleaning nozzle as defined in claim 1-4, characterized in that the second one of the at least two disc elements is embedded by friction.

* * * * *